United States Patent [19]

Beer

[11] Patent Number: 4,835,037

[45] Date of Patent: May 30, 1989

[54] ROLL OF LAMINATED WEB PRODUCT USABLE FOR FORMING SMOOTH-WALLED FLEXIBLE PACKAGES

[75] Inventor: Jeffrey S. Beer, Perkiomenville, Pa.

[73] Assignee: Fres-co System USA, Inc., Telford, Pa.

[21] Appl. No.: 160,618

[22] Filed: Feb. 26, 1988

Related U.S. Application Data

[62] Division of Ser. No. 47,604, May 7, 1987, Pat. No. 4,727,706, which is a division of Ser. No. 789,793, Oct. 21, 1985, abandoned.

[51] Int. Cl.[4] ..... B27N 5/02

[52] U.S. Cl. ..... 428/35.2; 428/195; 428/198; 428/906; 426/127; 426/410; 426/594; 53/432; 53/434; 53/449; 206/390; 206/522; 206/554; 383/3; 383/109; 383/113; 383/116

[58] Field of Search ..... 426/594, 410, 127; 53/432, 434, 445; 206/390, 522, 554; 383/3, 109, 113, 116; 428/195, 198, 35.2, 906

[56] References Cited

U.S. PATENT DOCUMENTS

| | | | |
|---|---|---|---|
| 4,478,858 | 10/1984 | Baird et al. | 426/594 |
| 4,629,064 | 12/1986 | Barner | 383/113 |
| 4,681,781 | 7/1987 | Murray et al. | 428/35 |
| 4,756,422 | 7/1988 | Kristen | 383/113 |

FOREIGN PATENT DOCUMENTS

| | | |
|---|---|---|
| 0160755 | 11/1985 | European Pat. Off. . |
| 0174198 | 3/1986 | European Pat. Off. . |
| 2824397 | 12/1978 | Fed. Rep. of Germany . |
| 202032 | 8/1983 | Fed. Rep. of Germany . |
| 2022831 | 6/1969 | France . |
| 0746165 | 2/1970 | France . |
| 2085401 | 4/1982 | United Kingdom . |
| 2090577 | 7/1982 | United Kingdom . |

*Primary Examiner*—Ellis P. Robinson
*Assistant Examiner*—P. J. Ryan
*Attorney, Agent, or Firm*—Ceaesar, Rivise, Bernstein, Cohen & Pokotilow, Ltd.

[57] ABSTRACT

A roll of continuous laminated web product usable for forming a flexible package includes a first continuous flexible web formed of a gas barrier material adapted to form an inner bag of the package, and a second continuous flexible web adapted to form an outer bag of the package. The first and second webs are adhered together by adhesive bonds in the form of a discrete pattern of bonded areas which repeats in the machine-direction of the laminated web construction to define a plurality of sequentially disposed, dual walled sheets between such discrete patterns of bonded areas. Each of the discrete patterns of bonded areas includes discrete bonds which are spaced-apart from each other in the cross-machine-direction of the roll to define at least one passageway between the discrete bonds. The first continuous flexible web and the second continuous flexible web of the roll are of different materials to preclude sealing of the at least one passageway when a bonding energy is applied to the dual walled sheets for sealing upper and lower sections of the package with the contents in the inner bag of the package being under vacuum.

2 Claims, 2 Drawing Sheets

ROLL OF LAMINATED WEB PRODUCT USABLE FOR FORMING SMOOTH-WALLED FLEXIBLE PACKAGES

RELATED APPLICATIONS

This application is a divisional application of pending U.S. application Ser. No. 47,604 filed on May 7, 1987, for Method For Forming Smooth Walled Flexible Package, now U.S. Pat. No. 4,727,706, which in turn is a divisional application of U.S. application Ser. No. 789,793 filed on Oct. 21, 1985, now abandoned.

FIELD OF INVENTION

This invention relates generally to containers, and more particularly, to roll stock for forming smooth-walled containers.

BACKGROUND ART

Conventional flexible vacuum packaging for food products have heretofor utilized a container formed of a multi-layer sheet material, such as layers of plastic and foil. The materials forming layers of the container are selected in the interest of strength and maintaining the vacuum to prevent the ingress of air into the container. If the contents of the container or package is of a particulate nature, such as ground or whole bean coffee, the vacuumization of the package to seal the coffee therein results in an uneven, rough or pebblely appearance of the container's walls as they attempt to conform to the particulate surface the package's contents. Accordingly, it is a common practice of the prior art to overwrap the vacuum package in a bag or covering of paper. The overwrapping paper is printed to carry the desired graphics and text for the package. Since the paper covering or wrapping the package is not under vacuum it retains its generally smooth surface.

While the above packaging is suitable for its intended purposes, the paper overwrap must be applied to the vacuumized inner package on "off-line" or specially constructed equipment, thereby increasing manufacturing costs and expenses.

Another alternative embodiment to the foregoing packages is the utilization of a single, thicker walled container formed of many layers, e.g., four or more, so that when the flexible material wall conforms to the material within the package it takes less of the rough appearance of the enclosed product than is the case of thinner walled packages. While this alternative construction provides a package which is more aesthetically pleasing than the foregoing packages, it still leaves much to be desired.

Examples of prior art packaging formed of inner and outer packages spaced from one another by a gas space are shown in United Kingdom Patent Application GB-2085401 and French Pat. No. 2022831.

DISCLOSURE OF INVENTION

This invention relates to a roll of laminated web product usable for forming a flexible package holding products under vacuum and which exhibits an attractive and smooth appearance. The roll of continuous, laminated web product includes a first continuous flexible web formed of a gas barrier material adapted to form an inner bag of the package, and a second continuous flexible web adapted to form an outer bag of the package. The first and second continuous webs are adhered together by adhesive bonds to form the laminated web construction. The adhesive bonds include a discrete pattern of bonded areas which repeats in the machine-direction of the laminated web construction to define between discrete patterns of bonded areas a plurality of sequentially disposed, dual walled sheets. Each of the dual walled sheets has a length required to form a package, and each of the discrete patterns of bonded areas includes discrete bonds which are spaced-apart from each other in the cross-machine-direction of the roll to define between the discrete bonds at least one passageway between the first and second continuous webs. The first continuous flexible web and the second continuous flexible web of the laminated web construction are of different materials to preclude sealing of at least one passageway when a bonding energy is applied to the dual walled sheets for sealing upper and lower sections of the package with the contents in the inner bag being under vacuum in said package. The machine-direction spacing between the discrete patterns of bonded areas permits separation of the web construction through the discrete patterns of bonded areas which are spaced-apart from each other in the machine-direction, to thereby form a plurality of the dual walled sheets from which the packages are constructed.

The package is continuously formed from the laminated web product and is formed of flexible sheet material(s) for holding a product, such as coffee, under vacuum therein when the package is sealed. The package is in the form of a container comprising an inner bag, and an outer bag. The inner bag is formed by a sheet or wall of the first, gas-barrier material. The package has a top end in the form of a sealable, open mouth to provide access to the interior thereof and a sealed bottom end. The outer bag extends about the inner bag and is secured thereto at selected areas or portions, including at the top and bottom of said bags, by the discrete pattern of adhesive bonds. The inner and outer bags are separated from each other by a space into which air may flow. The selected portions or areas at which the inner and outer bags are joined together define at least one passageway between them at the top and bottom of said bag so that when the package is filled and its mouth sealed so that the contents therein are under vacuum, gas may flow through the passageways into the gas space so that the outer bag provides a smooth, aesthetically pleasing appearance notwithstanding the close conformance of the inner bag to the contents of the package.

Other objects and a fuller understanding of the invention will be had by referring to the following description of the Best Mode Of The Invention, taken in conjunction with the accompanying drawings.

BEST MODE OF THE INVENTION

Figure 1:
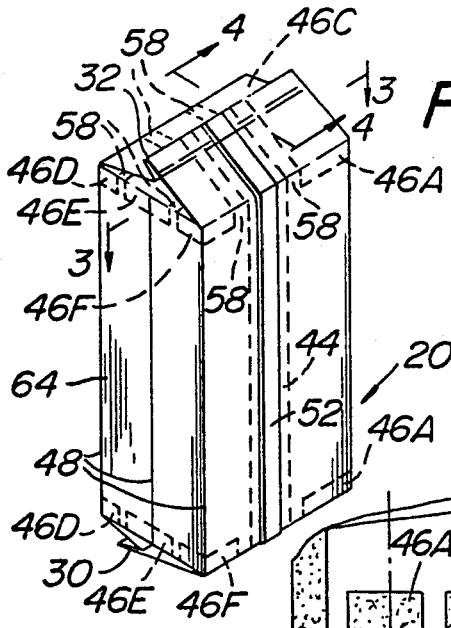
FIG. 1 is a perspective view of a flexible package constructed in accordance with the subject invention.

Referring now to the various figures of the drawing wherein like reference characters refer to like parts there is shown at 20 a gussetted flexible package constructed with a roll of continuous laminated web product in accordance with the subject invention. That package is arranged for holding a product such as coffee 22, under vacuum therein.

The package 20 is of a dual walled construction that includes an inner bag 24 and an outer bag 26. A gas space 28 is formed between the inner and outer bags. The ambient atmosphere is arranged to gain ingress into the gas space 28 through at least one passageway adjacent the top and bottom of the package, to be described later. The gas space 28 enables the wall of the inner bag 24 of the package to closely conform to the contents thereof when the package is sealed under vacuum, while enabling the wall of the outer bag 26 to remain free, that is not in tight conformance to the outer surface of the inner wall, so that the outer wall remains in a smooth, aesthetically pleasing state.

The inner bag is constructed of a web or sheet of flexible material, to be described in detail later. The outer bag is also constructed of a sheet or web of flexible material, and will also be described in detail later. The inner bag or container is located within the outer bag and is secured thereto at a bottom marginal flap or seam 34, and at the top or mouth 36 of the package, as will be described in detail later. The contents 22 are arranged to be disposed within the inner bag.

In accordance with the preferred embodiment of this invention the inner bag is formed of a flexible sheet material which is strong, tough, and substantially impervious to the passage of gas, e.g., air, therethrough to insure that the product held under vacuum in the inner bag remains under vacuum and not exposed to the deleterious effects of the ambient atmosphere. Thus, in accordance with the preferred embodiment of this invention, the wall 24 is formed of a tripartite or three layer construction. In particular the wall 24 consists of an outer layer formed of a transparent material, e.g., polypropylene, a middle layer formed of a metal, e.g., aluminum, foil, and an inner layer formed of another plastic, e.g., polyethylene.

The outer wall 26 is formed of a material which is preferably strong and tough, but which need not be impervious to the passsage of air therethrough. In accordance with the preferred embodiment of the invention the outer wall is formed of a sheet of polyester film.

Graphics, text or artwork for the package 20 can be either printed on the outer surface 24 of the outer wall 26 or on its inner surface 36. In the latter case the material making up the wall 26 should be transparent and the graphics, text or artwork should be printed in reverse on the inner surface 36 so it can be readily visable through the wall 26. Alternatively the graphics, text or art work can be printed on the outer surface 38 of the wall of the inner bag 24. If the wall of the inner bag is formed of the tripartite construction as mentioned heretofore the graphics, text or artwork can be printed on outer surface 38 of the polypropylene layer or on the foil layer so as to be visible through the polypropylene layer. These latter alternatives are not preferred inasmuch as any graphics on the inner bag would necessarily be of a pebbled or unsmooth appearance due to the close conformation of the bag to its contents.

The outer and inner bags, 26 and 24, are formed from a roll of continuous laminated web product including continuous webs of material 40 and 42, respectively. Those webs are adhesively secured together and wound up on a single roll (not shown) to form a dual walled web. That web is then cut into dual walled sheets, as will be described later. The dual walled sheet is then formed into a respective package 20, including a vertically extending back seam or fin, to be described later, and the package is heat sealed along its bottom edge 30. The resulting open mouth package is then ready for filling and vacuumization.

Figure 2:
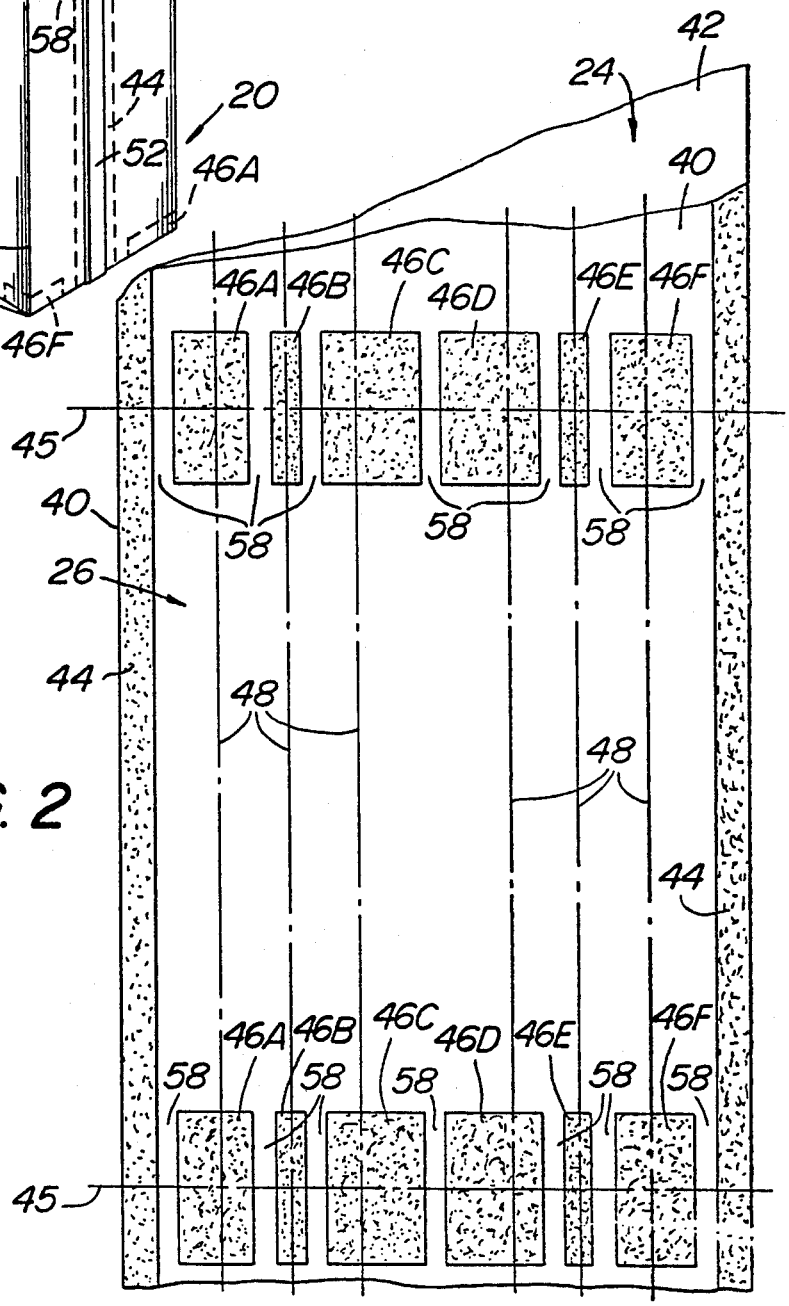
FIG. 2 is an enlarged, fragmentary plan view of a portion of the roll of continuous laminated web product of this invention, which is used to form the package of FIG. 1.

The two webs 40 and 42 are secured together prior to the formation of the package via the use of plural prepatterned areas of adhesive. The adhesive areas are applied to either the inner surface 36 of the web 40 forming the outer sheet 26 or to the outer surface 38 of the web 42 forming the inner sheet 24, or to both surfaces. In accordance with the embodiment shown herein the areas of adhesive are applied to the inner surface 36 of the web 40. Thus, as can be seen clearly in FIG. 2 the continuous web or strip 40 of material for making the outer walls of plural packages 20 has applied to its inner surface a plurality of areas of an adhesive. Preferably the adhesive consists of polyurethene and is applied as a liquid along marginal areas 44 extending along the full length of each side of the web 40 as well as in plural longitudinally spaced groups of discrete areas 46A, 46B, 46C, 46D, 46E, and 46F extending transversely across the web.

The web 42 for making up the inner walls of plural packages 20 is disposed over the web 40 so that the two webs are adhesively secured together by the interposed adhesive areas 44 and 46A–46F and the resulting construction is rolled up on a single roller (not shown) to form the roll of continuous laminated web product in accordance with this invention. If the adhesive utilized is polyurethane the adhesive is activated by heat to seal the two webs together. It must be pointed out at this juncture that any type of adhesive, be it heat activated or pressure sensitive, etc. can be used.

Figure 3:
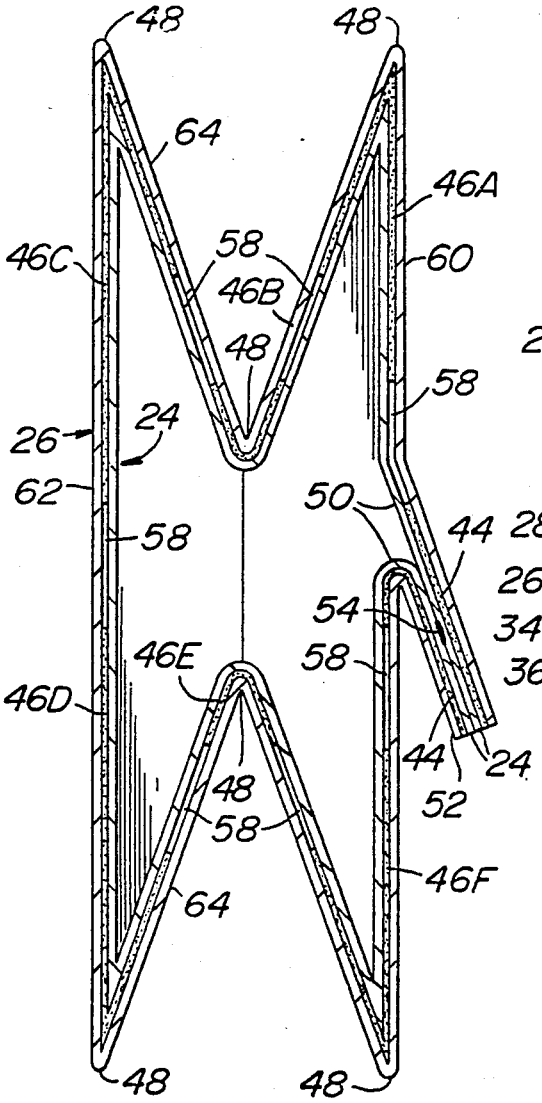
FIG. 3 is an enlarged sectional view taken along line 3—3 of FIG. 1.

The roll of the two joined webs is then used to form a gussetted package by folding the joined webs along longitudinally extending fold lines 48 so that the inner surface 50 of the two marginal edges of the inner wall 25 abut in a vertically extending fin 52. The fin 52 is sealed by the application of heat to join those abutting surfaces together along a vertical seal line 54 (FIG. 3). The resulting tubular, dual walled construction is then severed along cut lines 45 (FIG. 2) which extend transversely through the respective groups of the adhesive areas 46A to 46F at approximately the middle of each group.

The bottom edge of the package 20 is then heat sealed in a similar manner to fin 52. To that end the marginal portions of the inner surface of the inner wall 24 continguous with the bottom edge of the package are brought into engagement with each other and heat is applied to seal them together along a seal line (not shown).

Figure 4:
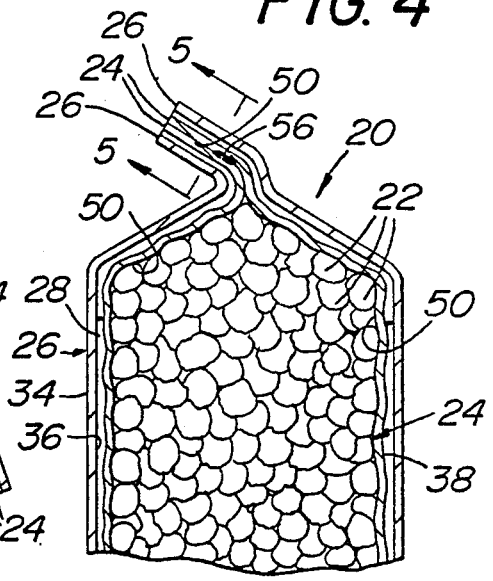
FIG. 4 is an enlarged sectional view taken along line 4—4 of FIG. 1.
Figure 5:
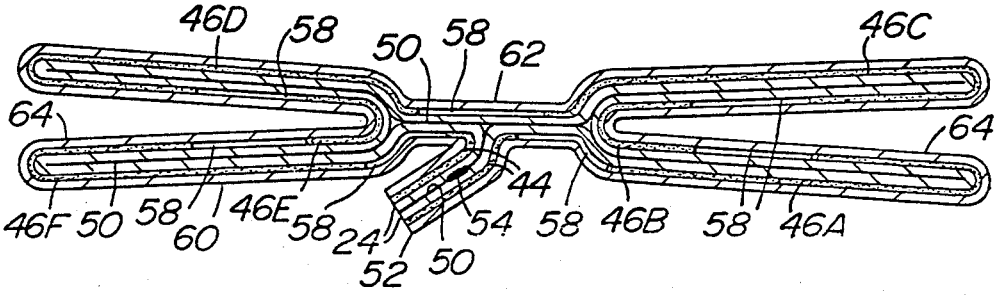
FIG. 5 is a sectional view taken along line 5—5 of FIG. 4.

The package 20 is now ready for filling and vacuumization. To that end the product 22 of the package is placed therein through the package's open mouth 32. The package is then placed in a conventional vacuum sealing apparatus (not shown), whereupon the air is withdrawn from the interior bag of the package and the marginal edge portions of the inner surface 50 contiguous with the mouth 32 (top) of the package are brought into engagement and sealed along a seal line 56 (FIG. 4) by the application of heat thereto.

It should be pointed out at this juncture that the package may be sealed along its fin and the bottom and top ends by other means than heat sealing, such as ultrasonic sealing, etc.

As should be appreciated by reference to the drawings the spaces between the contiguous adhesive areas 46A to 46F and 44 define respective passageways 58 between themselves and the inner and outer walls 24 and 26 of the package. Thus, as can be seen a pair of passages 58 are located in the back 60 of the package on either side of the fin 52 at the top and bottom ends of the package. A single passage 58 is located in the front 62 of the package in the center of the top and bottom portions thereof, and a pair of passages 58 is located in each of the gussetted sides 64 of the package at the top and bottom end thereof.

In accordance with this invention passageways 58 may also be provided in the fin 52 by utilizing sections of adhesive areas in lieu of the continuous adhesive area 44 extending the entire length of the fin 52.

It must be pointed out at this juncture the materials forming the inner and outer bags are selected so that the application of energy, e.g., heat, to effect the sealing of the top, bottom and back seams of the package will not effect the sealing of the inner bag to the outer bag at the passageways.

Each passageway enables air from the ambient atmosphere to pass therethrough and into the space 28 between the inner and outer walls of the package, thereby enabling the front wall to remain smooth and aesthetically pleasing, not withstanding the fact that the inner wall may be pebbled or unsmooth due to its tight conformation with the contents of the package.

Without further elaboration the foregoing will so fully illustrate my invention that others may, by applying current or future knowledge, readily adapt the same for use under various conditions of service.

What is claimed as the invention is:

1. A roll of continuous, laminated web product usable for forming a smooth-walled flexible package, said web product including a first continuous flexible web formed of a gas barrier material adapted to form an inner bag of said package, and a second continuous flexible web adapted to form an outer bag of said package, said first and second continuous webs being adhered together by adhesive bonds to form said laminated web construction, said adhesive bonds including a discrete pattern of bonded areas which repeats in the machine-direction of the laminated web construction to define between discrete patterns of bonded areas a plurality of sequentially disposed, dual walled sheets, each of said dual walled sheets having a length required to form a package, each of said discrete patterns of bonded areas including discrete bodns which are spaced-apart from each other in the cross-machine-direction of the roll to define between said discrete bonds at least one passageway between said first and second continuous webs, said first continuous flexible web and said second continuous flexible web of the laminated web construction being of different materials for precluding sealing of the at least one passageway when a bonding energy is applied to the dual walled sheets for sealing upper and lower sections of the package with contents in the inner bag of said package under vacuum, the machine-direction spacing between the discrete patterns of bonded areas permitting separation of the web construction through discrete patterns of bonded areas which are spaced apart from each other in the machine-direction to thereby form a plurality of said dual walled sheets.

2. The roll of claim 1, wherein opposed side margins of said first and second continuous flexible webs are bonded together by adhesive areas spaced-apart in the machine-direction and separated by passageways.

* * * * *